US008523039B2

(12) United States Patent
Sugihara

(10) Patent No.: US 8,523,039 B2
(45) Date of Patent: Sep. 3, 2013

(54) STAPLER

(75) Inventor: Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 259 days.

(21) Appl. No.: 12/964,979

(22) Filed: Dec. 10, 2010

(65) Prior Publication Data

US 2011/0147431 A1 Jun. 23, 2011

(30) Foreign Application Priority Data

Dec. 23, 2009 (JP) ..... 2009-291554

(51) Int. Cl.
*B25C 7/00* (2006.01)

(52) U.S. Cl.
USPC ..... 227/155; 227/110

(58) Field of Classification Search
USPC ..... 227/110, 111, 155, 156; 270/58.02, 270/58.08, 58.09
See application file for complete search history.

(56) References Cited

U.S. PATENT DOCUMENTS 5,806,750 A * 9/1998 Yamanushi et al. ..... 227/155
H1842 H 3/2000 Tontarski
6,223,965 B1 * 5/2001 Nakatsuka ..... 227/111
6,641,024 B2 * 11/2003 Sato et al. ..... 227/155
2004/0238589 A1 * 12/2004 Abe ..... 227/110

FOREIGN PATENT DOCUMENTS

EP 1 459 858 A1 9/2004
EP 1518650 A1 3/2005
JP 2000-185868 7/2000

* cited by examiner

*Primary Examiner* — Alexandra Elve
*Assistant Examiner* — Nathaniel Chukwurah
(74) *Attorney, Agent, or Firm* — Drinker Biddle and Reath LLP

(57) ABSTRACT

A stapler is provided with a driver support part which supports an actuating mechanism of a driver; a clincher support part which is arranged apart from the driver support part in an up/down direction and to which a clincher is fixed; a positioning member provided in a vicinity of one of the clincher support part and the driver support part; a first positioning element provided on the positioning member; and a second positioning element provided on the one of the clincher support part and the driver support part. The driver support part and the clincher support part are simultaneously movable in a right/left direction by substantially the same amount. In cooperation with a clamping operation, the first positioning element and the second positioning element engage with each other.

8 Claims, 11 Drawing Sheets

STAPLER

BACKGROUND OF THE INVENTION

1. Field of the Invention

The present invention relates to a saddle-stitching stapler.

2. Related Art

In a saddle-stitching stapler, a staple can be driven in an intermediate portion of sheets of paper. When the staple is driven in a fold of the sheets of paper, the sheets of paper are formed to a booklet. In the saddle-stitching stapler, generally, a driver for driving the staple, and a clincher for clinching leg portions of the driven staple which have penetrated through the sheets of paper are arranged apart in an up/down direction. As a method of clinching the leg portions of the staple in the saddle-stitching stapler, there are a movable clincher type and a fixed clincher type. In the movable clincher type, after the entirety of the staple leg portions has completely penetrated through the sheets of paper, a movable clincher rotates and the leg portions are clinched. In the fixed clincher type, immediately after leading ends of the staple leg portions have penetrated through the sheets of paper, the staple leg portions are guided into grooves of a clincher and clinched.

Of these two types, the fixed clincher type is used widely in an inexpensive low-speed finisher to an expensive high-speed finisher. The reason is that: since the fixed clincher type does not require a clincher actuating mechanism and has the simple structure, the cost can be held down and space reduction is enabled. Further, another reason is that: since technology of folding thick paper at one time has not been established yet, a stapler mounted on the finisher does not need an ability of stapling 25 to 30 or more paper sheets.

In the fixed clincher type, the leg portions of the staple driven out by the driver are taken in the clincher grooves and bent so as to form a straight line. Therefore, even in case that front/rear misalignment between the driver and the clincher occurs a little, disadvantages such as an inclination of the staple and overlap of the staple leg portions are not produced. Namely, an acceptable range relating to the front/rear misalignment between the driver and the clincher is wide. On the other hand, the clincher in the fixed clincher type is fixed and the clincher grooves are formed in the shape of bilateral symmetry. Therefore, in case that there is misalignment in a right/left direction between the driver and the clincher, even if its misalignment is small, the both-side leg portions bend unequally. Namely, when a leading end of one leg portion abuts on a high portion of a slant surface of one-sided clincher groove, a leading end of the other leg portion abuts on a lower portion on a slant surface of the other-sided clincher groove, so that the both leg portions are difficult to bend equally. Accordingly, in the fixed clincher type, an acceptable range relating to the right/left misalignment between the driver and the clincher is narrow. Thus, very sever accuracy is required for the right/left alignment between the driver and the clincher, and an ambitious jig and a complicated structure are required for alignment.

Further, in a finisher disclosed in JP-A-2000-185868, a driver and a clincher are movable in the right/left direction by respective timing belts (transport belts). In this finisher, it is intended that the both belts are laid around pulleys provided for the same axis thereby to move simultaneously the driver and the clincher in the same direction by the same amount.

However, in the structure in which both of the clincher and the driver are carried by the timing belts, it is difficult to keep a relative position between the clincher and the driver constant due to expansion and flexure of the timing belt. Therefore, for commercialization of a finisher of up/down separation type which adopts a fixed clincher and has moving mechanisms for a clincher and a driver, it is necessary to perform control by means of an expensive stepping motor in order to keep the relative position between the clincher and the driver constant. In result, an entire stapler becomes expensive, and it is very difficult for the stapler adopting the fixed clincher type to realize the structure in which the driver and clincher are moved in a separation manner.

SUMMARY OF THE INVENTION

The invention provides a stapler which enables positioning of a driver and a clincher in a stapling time with good accuracy by simple structure.

In accordance with one or more embodiments of the invention, a stapler is provided with a driver support part 4 which supports a drive mechanism of a driver 2 that drives a staple toward sheets of paper; a clincher support part 6 which is arranged apart from the driver support part 4 in an up/down direction and to which a clincher 5 that clinches the driven-out staple is fixed; a positioning member 18, 9, 25 provided in a vicinity of one of the clincher support part 6 and the driver support part 4; a first positioning element 21, 24 provided on the positioning member 18, 9, 25; and a second positioning element 20, 22 provided on the one of the clincher support part 6 and the driver support part 4. The clincher support part 6 and the driver support part 4 are simultaneously movable in a right/left direction by substantially the same amount. After a clamping operation of clamping the sheets between the driver support part 4 and the clincher support part 6, the driver 2 carries out a stapling operation. The first positioning element 21, 24 and the second positioning element 20, 22 are configured to engage with each other in cooperation with the clamping operation.

DETAILED DESCRIPTION OF THE EXEMPLARY EMBODIMENTS

<First Exemplary Embodiment>

Figure 1:
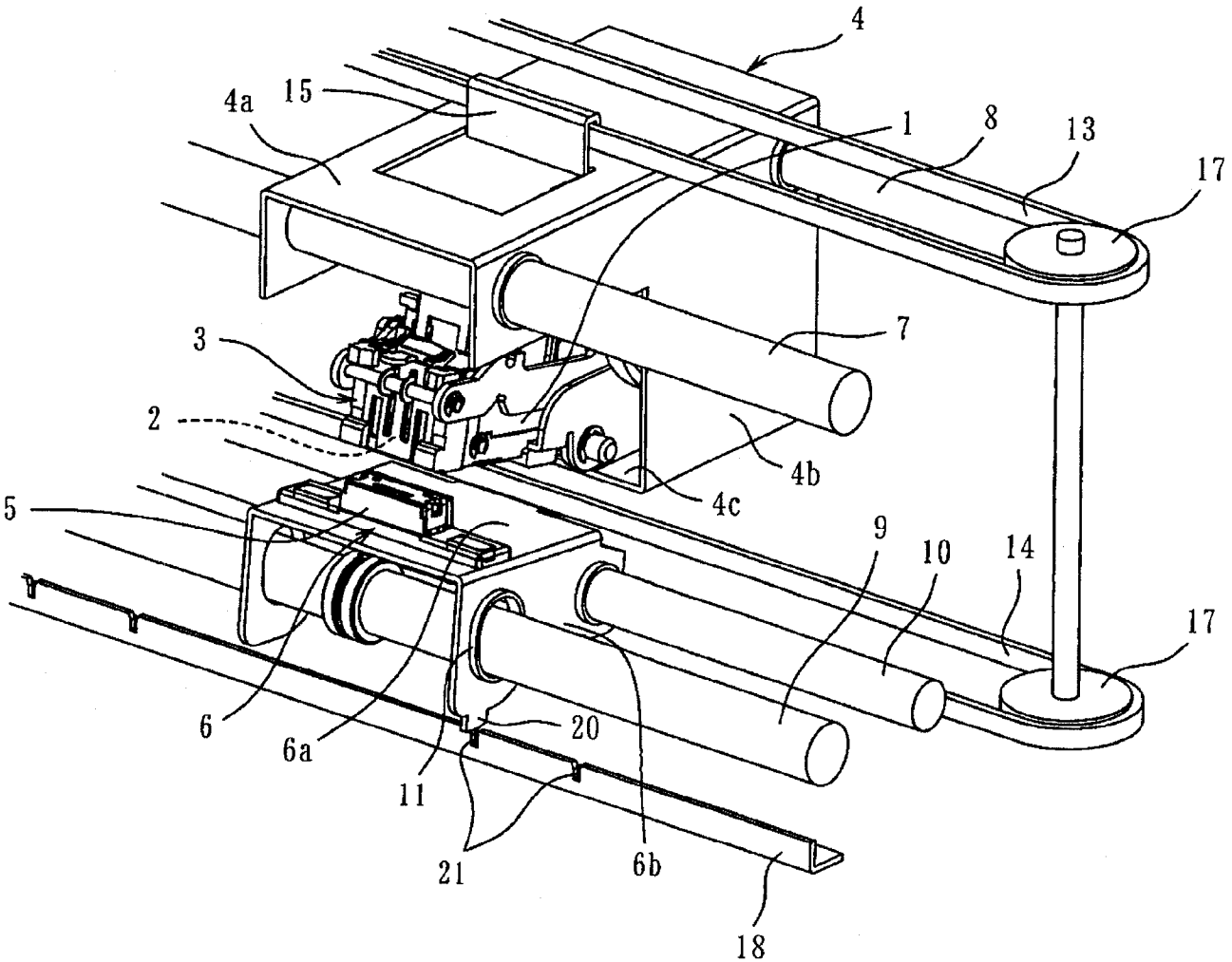
FIG. 1 is a perspective view of a main part of a saddle stitching stapler of both-side moving type according to a first exemplary embodiment of the invention.
Figure 2:
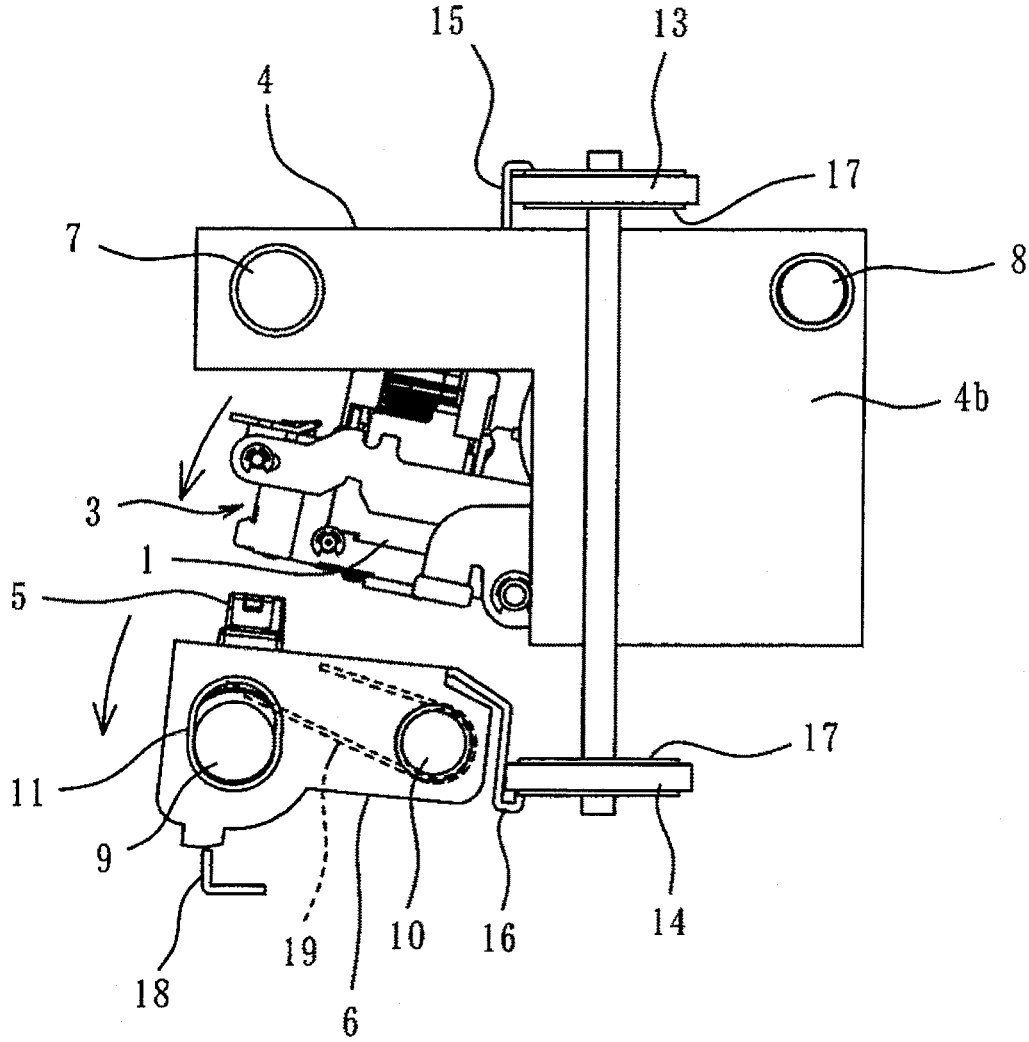
FIG. 2 is a side view of the saddle stitching stapler.

FIG. 1 is a perspective view of a main part of a saddle stitching stapler, and FIG. 2 is a side view of the saddle stitching stapler. In this saddle stitching stapler, an upper bracket (driver support part) 4 which supports a magazine unit 3 including a staple accommodating magazine 1 and a driver 2 which drives out a staple supplied from this magazine 1 toward sheets of paper, and a lower bracket (clincher support part 6) which supports a clincher 5 for clinching the driven-out staple are arranged apart in an up/down direction. Generally, the saddle stitching stapler is installed in a paper handling device as a paper finisher provided at a back stage of an image forming apparatus such as a copying machine or a printer. The driver 2 is provided at a front end portion of the magazine 1 movably in the up/down direction, and constituted so as to operate together with the magazine 1 in the clamping time of sheets of paper and to carry out a staple driving operation independently of the magazine after completion of the clamping operation.

The upper bracket 4 is formed in the shape of a box by an upper plate portion 4*a*, side plate portions 4*b* and a bottom plate portion 4*c*, the bottom plate portion 4*c* is provided with a drive mechanism of the driver 2, and the magazine unit 3 is provided rotatably in the up/down direction. The lower bracket 6 is formed in the C-shape which opens downward by an upper plate portion 6*a* and side plate portions 6*b*, and the clincher 5 is fixed to the upper plate portion 6*a*. The magazine unit 3 and the clincher 5 are arranged in positions corresponding to each other up and down.

The upper bracket 4 and the lower bracket 6 are operation-coupled through a two-side moving mechanism. Namely, the upper bracket 4 is provided slidably for two front and rear upper guide shafts 7 and 8 which are parallel, and the lower bracket 6 is also provided slidably for two front and rear lower guide shafts 9 and 10 which are parallel. The upper guide shafts 7, 8 and the lower guide shafts 9, 10 are arranged also in parallel to each other.

Both of the lower guide shafts 7 and 8 are fitted in the side plate portion 4*b* of the upper bracket 4 with little gap. To the contrary, though the rear shaft 10 of the lower guide shafts is similarly fitted in the side plate portion 6*b* of the lower bracket 6, the front shaft 9 is loosely inserted into a vertically-long through-hole 11 formed in the front portion of the side plate portion 6*b*. Accordingly, the lower bracket 6 can be moved rotationally around the rear shaft 10 in the up/down direction by dimensional difference, and the lower bracket 6 is urged by a torsion coil spring 19 so that its front side is usually located in the upper end position as shown in FIGS. 1 and 2.

Further, at the rear portions of the upper guide shafts 7, 8 and the lower guide shafts 9, 10, an upper transport belt 13 and a lower transport belt 14 for transporting respectively the upper bracket 4 and the lower bracket 6 are arranged, and the upper bracket 4 and the lower bracket 6 are fixed respectively to the upper transport belt 13 and the lower transport belt 14. At the upper portion of the upper bracket 4, a fixed piece 15 is formed, which is fixed to the upper transport belt 13 by caulking. The lower bracket 6 is similarly fixed through a fixed piece 16 formed at its rear portion to the lower transport belt 14. Further, the upper transport belt 13 and the lower transport belt 14 are respectively laid around pulleys 17 which are provided for the same axis and have the same diameter. Hereby, the rotation of the pulleys 17 moves the upper bracket 4 on the magazine unit 3 side and the lower bracket 6 on the clincher 5 side in the left and right directions, and the upper bracket 4 and the lower bracket 6 move simultaneously in the same direction by the same amount, whereby the relation in up/down position between the driver 2 and the clincher 5 is always kept the same.

The front portion of the lower bracket 6 is inclined upward by the torsion coil spring 19. Although the fixed piece 16 is also inclined at this time, since flexure is produced in the lower transport belt 14, the lower transport belt 14 can follow the inclination of the fixed piece 16.

Next, in the vicinity of the lower bracket 6, a lock plate (positioning member) 18 which determines a stapling pitch is arranged along the slide direction of the lower bracket 6 in parallel to the lower guide shaft. At the lower end of one side plate 6*b* of the lower bracket 6, a projection 20 is formed as a positioning element (second positioning element); and also at the upper edge portion of the lock plate 18, positioning grooves 21 are formed, at predetermined intervals in right/left direction, as a positioning element (first positioning element, positioning points). The upper end of the positioning groove 21 is formed a little widely. The positioning groove 21 is provided in the predetermined position in accordance with the size of sheets of paper and the stapling position.

Figure 3:
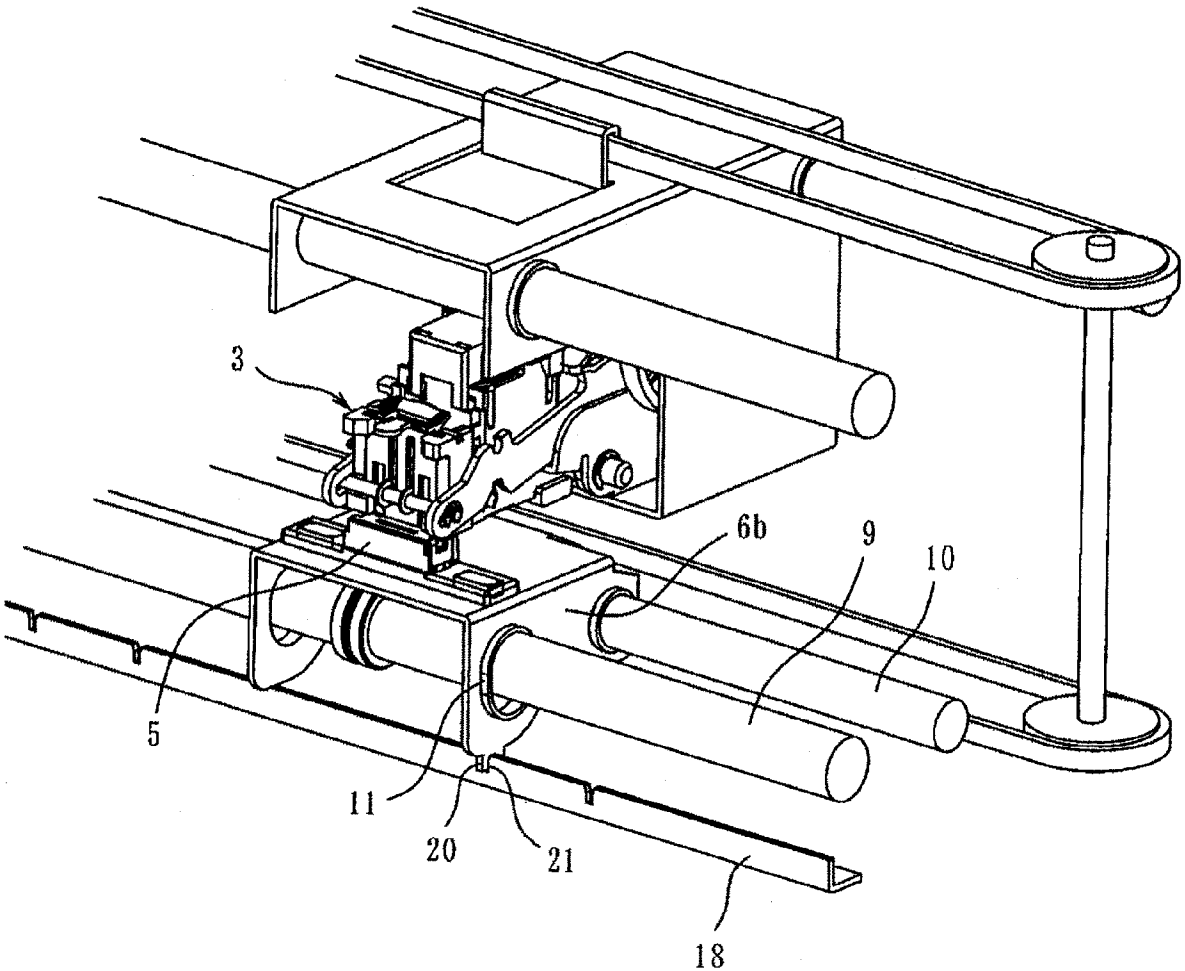
FIG. 3 is a perspective view showing a stapling operation of the saddle stitching stapler.
Figure 4:
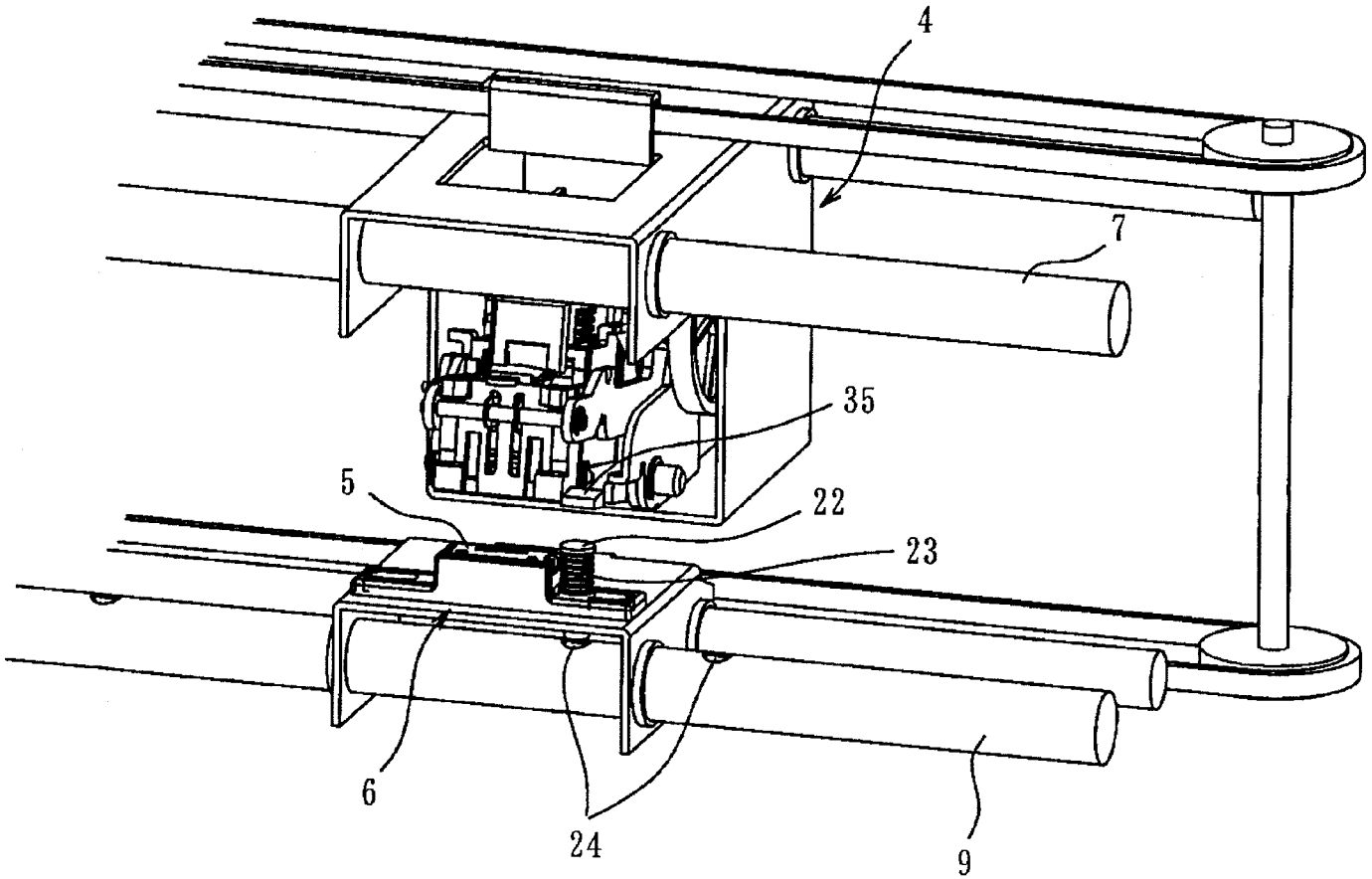
FIG. 4 is a perspective view of a main part of a saddle stitching stapler according to a second exemplary embodiment of the invention.

According to the aforesaid constitution, after the upper bracket 4 and the lower bracket 6 have been slid in the right/left direction in parallel and by the substantially same amount by driving the pulley 17 by a not-shown drive mechanism and carried in the predetermined positions, when sheets of paper (not shown) are put between the upper bracket 4 and the lower bracket 6 and the driver actuating mechanism is operated, the magazine unit 3 is moved rotationally downward as shown in FIG. 3 to clamp the sheets of paper between the magazine unit 3 and the clincher 5, the driver of the magazine unit 3 drives out a stapler in the sheets of paper, and leading ends of leg portions of the staples abut on the grooves of the clincher 5 and clinched, whereby the stapling operation is completed.

After the stapling operation has been completed, when the pulleys 17 are rotated, the transport belts 13 and 14 move, and the upper bracket 4 and the lower bracket 6 move simultaneously in the same direction by the same amount. Next, by stopping the rotation of the pulleys 17 in the predetermined position and operating the driver actuating mechanism, the stapling operation is simultaneously performed.

When the magazine unit 3 is moved rotationally downward by the operation of the driver actuating mechanism as described above and performs the clamping operation, the clamping force of the magazine unit 3 is transmitted through the sheets of paper to the lower bracket 6. Therefore, when clamping is started, the lower bracket 6 is moved rotationally downward around the rear shaft 10 in cooperation with this clamping operation, and the projection 20 formed in one side plate 6*b* engages with the positioning groove 21 of the lock plate 18.

Hereby, the lower bracket 6 and the clincher 5 are properly positioned and do not move in the right/left direction. Accordingly, after the leadings of the leg portions of the staple have abutted on the clincher 5, the relative position between the fixed clincher 5 side and the driver 2 side is kept. In result, even in case that a moving mechanism for the upper bracket 4 and the lower bracket 6, which does not have so much positioning accuracy in the transporting time, is used, accuracy of the relative position between the fixed clincher 5 and the driver 2 in the stapling time can be improved, and the resistance to lateral misalignment in the right/left direction due to clinching load can be improved greatly, whereby the stapling operation is surely performed.

As described above, according to the aforesaid saddle stitching stapler, by the simple structure, the driver 2 side and the clincher 5 side can be exactly positioned in the stapling time. Accordingly, commercialization of a finisher having a two-side moving mechanism, which is a stapler including the up/down separation typed driver 2 and fixed clincher 5, is possible enough.

Further, the number of parts for determining the stapling pitch is small, so that quality is stabilized.

Further, since the pressing power in the clamping time can be directly utilized in positioning, the special means for moving the clincher support part is not required, so that the structure is simplified.

Further, since the lock plate 18 is arranged along the slide direction of the upper bracket 4 and the lower bracket 6, and the positioning grooves 21 constituting the positioning elements are formed spacedly in the lock plate 18, the lock plate 18 can be readily machined.

Further, the positioning grooves 21 in the lock plate 18 are changed in response to specifications, and the position and the number of them are not limited to those in the figure.

Further, it is preferable that the positioning element is formed by a convex part and a concave part such as the projection and the groove. In the simple structure, by widening the opening end of the recess part, engagement of the convex part is guided and positioning can be surely performed. The projection and the groove may be provided in reverse positions to the above positions.

<Second Exemplary Embodiment>

Next, FIG. 2 is a perspective view of an example in which another form of positioning mechanism is provided in a similar saddle stitching stapler to that in the first exemplary embodiment except that a lower bracket 6 is not moved rotationally, in which a lock pin 22 as a positioning element (second positioning element) is provided movably in the up/down direction at the upper surface portion of the lower bracket 6. The lock pin 22 is always urged upward by a compression spring 23, and constituted so as to, when being pushed from the upside, penetrate the upper surface portion of the lower bracket 6, protrude downward and abut on the upper surface of a front shaft 9 of a lower guide shaft. The front shaft 9 is constituted as a positioning member, and positioning recess parts 24 as a positioning member (first positioning member, positioning points) are formed on the upper surface of the front shaft 9 at predetermined intervals in the right/left direction. The positioning recess part 24 is formed so that its upper end opening becomes wider toward the outside. In the second exemplary embodiment, as an example, the positioning recess part 24 is formed by a through-hole.

Further, an upper bracket 4 is provided with a pressing part 35 formed in a position corresponding to the lock pin 22.

Figure 5:
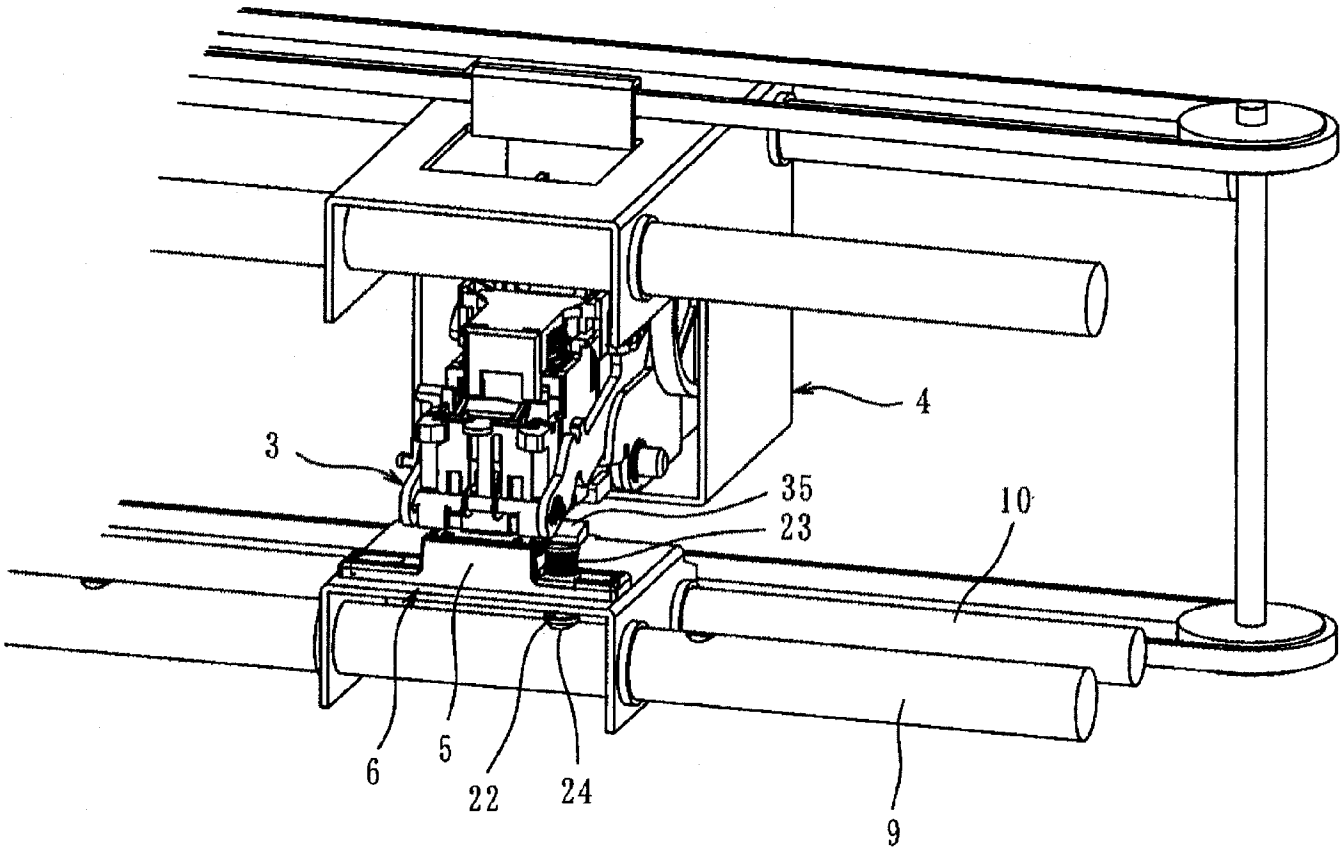
FIG. 5 is a perspective view of the saddle stitching stapler of FIG. 4 in a stapling operation state.

According to the aforesaid constitution, when sheets of paper are put between a driver actuating mechanism and a clincher 5 and the driver actuating mechanism is operated, a magazine unit 3 is moved rotationally downward as shown in FIG. 5 and then performs a clamping operation. At this time, the pressing part 35 of the upper bracket 4 also presses the sheets of paper.

Figure 6:
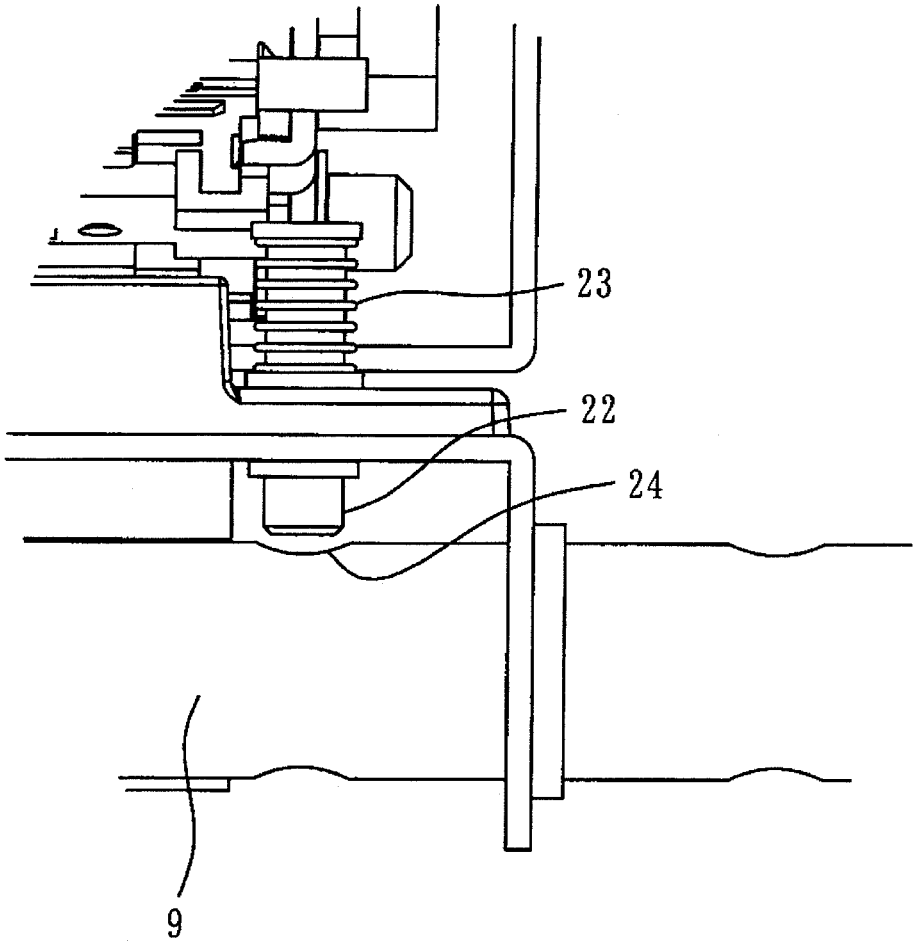
FIG. 6 is an enlarged side view of the main part in a state of FIG. 5

The clamping force of the magazine unit 3 is transmitted through the sheets of paper to the lower bracket 6. When clamping is started, the pressing part 35 of the upper bracket 4 presses down the lock pin 22 of the lower bracket 6 through the sheets of paper against the compression spring 23 in cooperation with this clamping operation. Therefore, as shown in FIG. 6, the lock pin 22 moves downward and locks in the positioning recess part 24 of the front shaft 9. Hereby, the lower bracket 6 and the clincher 5 are properly positioned and do not move in the right/left direction. Accordingly, after leading ends of leg portions of a staple have abutted on the clincher 5, the fixed clincher 5 and the driver 2 are automatically aligned in center of them, and the stapling operation is surely performed without causing lateral misalignment.

According to the saddle stitching stapler having the above constitution, by the simple structure, not only the clincher 5 side but also the driver 2 side can be properly positioned in the stapling time.

The shape of the positioning element is not the pin shape such as the lock pin but may be the ball shape.

<Third Exemplary Embodiment>

Figure 7:
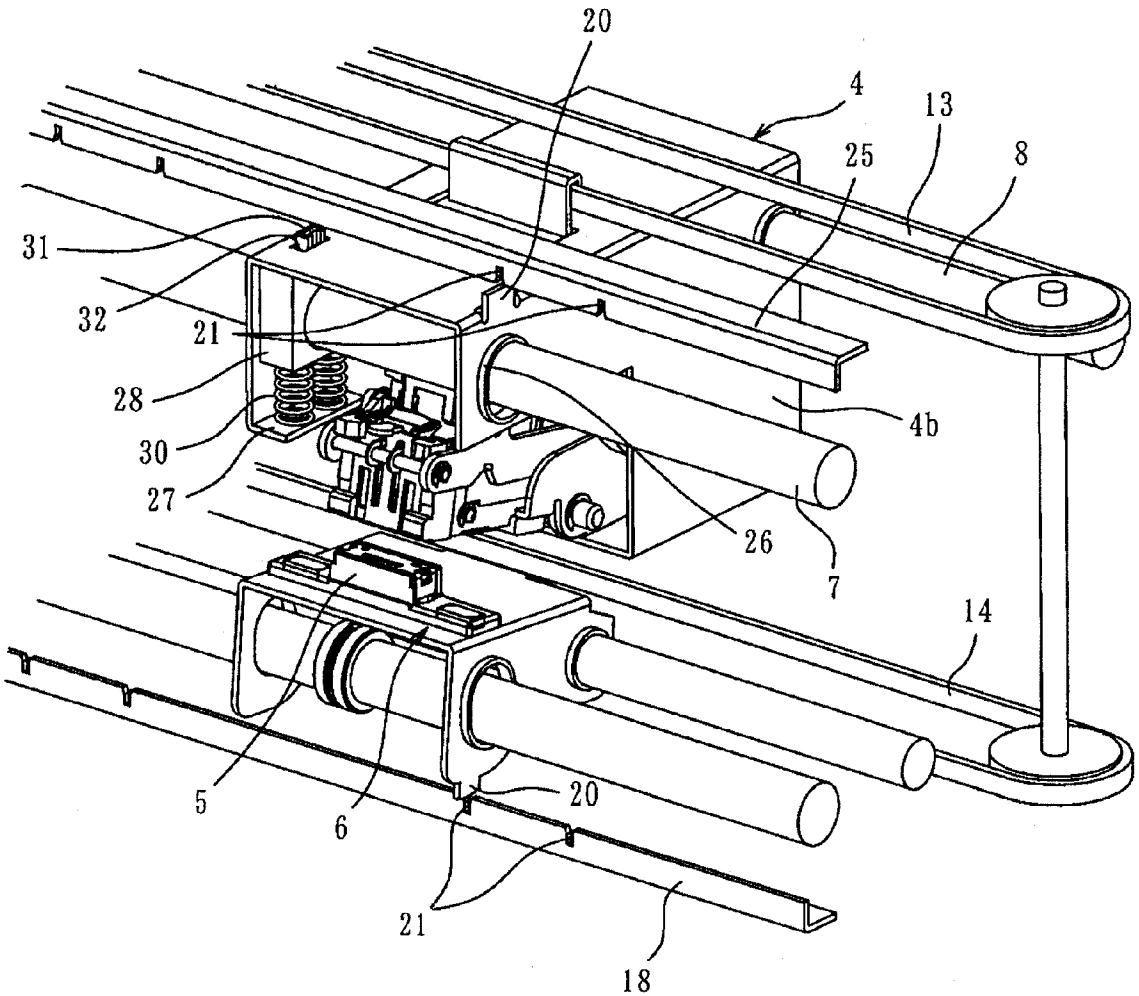
FIG. 7 is a perspective view of a main part of a saddle stitching stapler according to a third exemplary embodiment of the invention.
Figure 8:
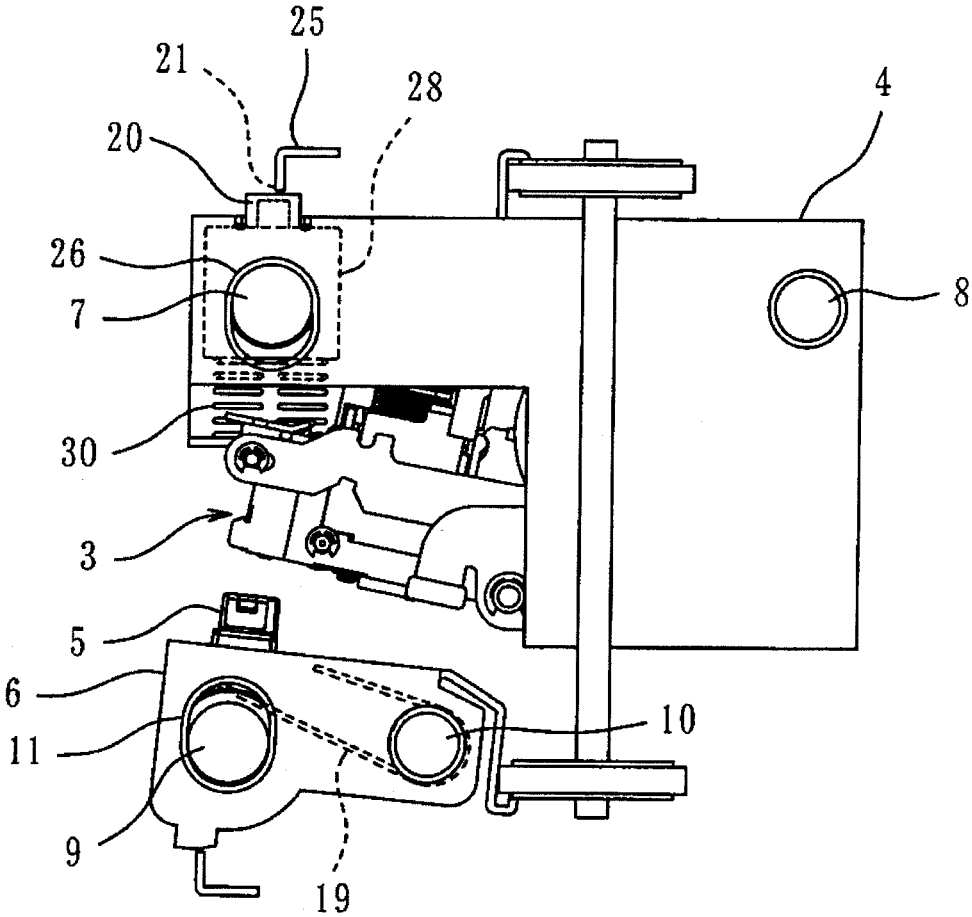
FIG. 8 is a side view of the saddle stitching stapler of FIG. 7.

Next, FIGS. 7 and 8 are a perspective view and a side view of an example in which another form of positioning mechanism is provided in a similar saddle stitching stapler to that shown in FIG. 1, in which the same positioning mechanism as that shown in FIG. 1 is provided in a lower bracket 6 and a lock plate 18, and further a positioning mechanism is provided in an upper bracket 4 and a upper lock plate (positioning member) 25 provided in the vicinity of the upper portion of the upper bracket 4 in parallel to upper guide shafts 7 and 8.

Namely, at the upper end of one side plate 4*b* of the upper bracket 4, a projection 20 is formed as a positioning element (second positioning element); and also at the lower edge portion of the upper lock plate, positioning grooves 21 are spacedly formed as a positioning element (first positioning element).

The lower end of the positioning groove 21 is formed a little widely. Though the rear shaft 8 of the upper guide shafts is fitted in the side plate portion 4*b* of the upper bracket 4, the front shaft 7 is loosely inserted into a vertically-long through-hole 26 formed in the front portion of the side plate portion 4*b*. Accordingly, the upper bracket 4 can move rotationally around the rear shaft 8 in the up/down direction by dimensional difference. Further, a compression spring 30 is arranged between a bending part 27 bending to the inside of the side plate portion 4*b* of the upper bracket 4 and a guide block 28 fitting to the upper guide shaft, and the upper bracket 4 is always urged by the compression spring 30 so as to move rotationally downward. Similarly, the lower bracket 6 is urged by a torsion coil spring 19 so as to be usually located in the upper position. At the upper portion of the guide block 28, a convex part 31 is formed, fitted into an opening part 32 in the upper bracket 4, and constituted so as to slide in the axial direction of the guide shaft 7 together with the upper bracket 4.

Figure 9:
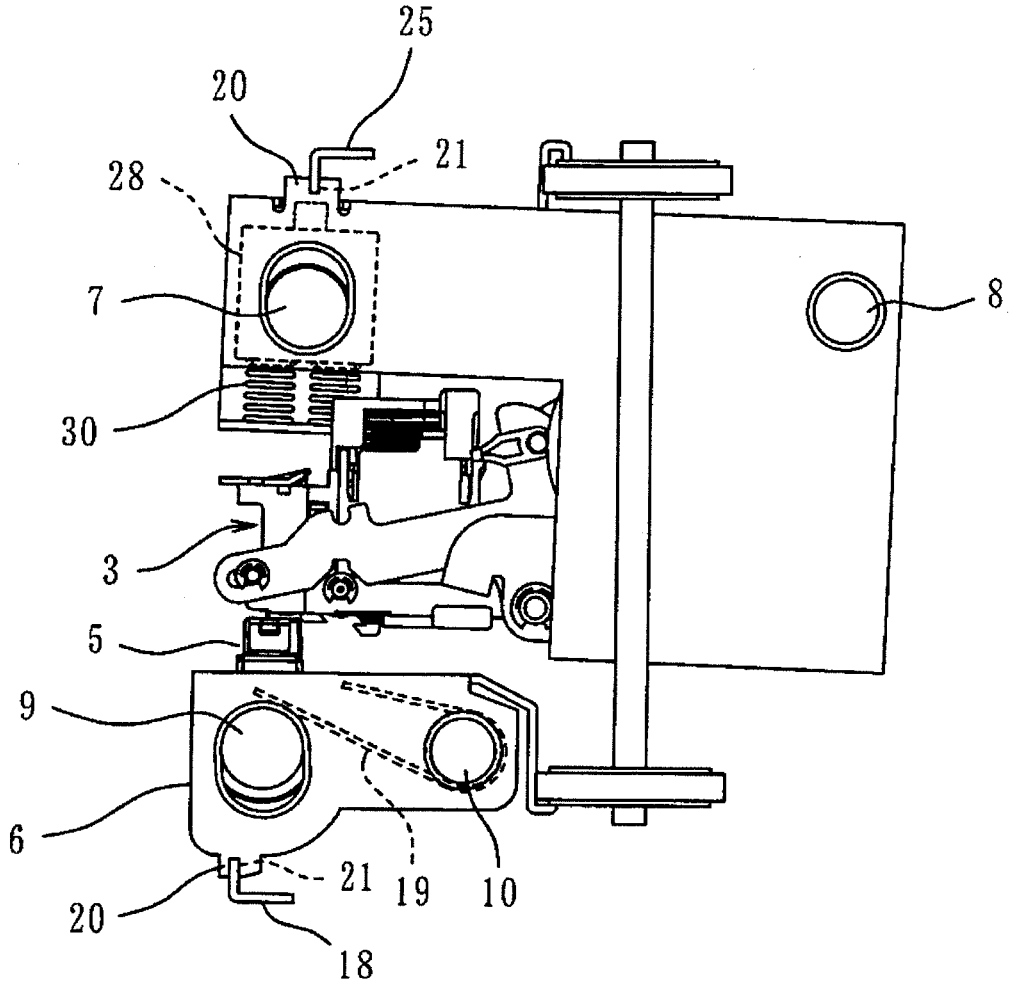
FIG. 9 is a side view of the saddle stitching stapler of FIG. 7 in a stapling operation state.

According to the aforesaid constitution, when sheets of paper are put between a driver actuating mechanism and a clincher 5 and the driver actuating mechanism is operated, a magazine unit 3 moves rotationally downward and performs the clamping operation. At this time, a pressing part of the upper bracket 4 also presses the sheets of paper. Since the clamping force of the magazine unit 3 is transmitted through the sheets of paper to the lower bracket 6, when clamping is started, the lower bracket 6 is moved rotationally downward around a rear shaft 10 in cooperation with this clamping operation as shown in FIG. 9, and the projection 20 formed in one side plate 6*b* engages with the positioning groove 21 of the lock plate 18.

The magazine unit 3 is so constituted as to even in case that the lower bracket 6 moves rotationally downward and then stops, move rotationally more downward in relation to the upper bracket 4 and sufficiently clamp the sheets of paper. Therefore, when the magazine unit 3 is not permitted to move rotationally, a portion which further keeps moving rotationally is absorbed by the upward rotational movement of the upper bracket 4 around the rear shaft 8 against the compression spring 30, and further by flexure of a compression spring (not shown) provided inside the stapler. When the upper bracket 4 moves rotationally upward, the projection 20 formed at the upper edge of the upper bracket 4 engages with the positioning groove 21 of the upper lock plate 25.

Regarding timing of engagement between the upper bracket 4 and the upper lock plate 25 and timing of engagement between the lower bracket 6 and the lower lock plate 18, previous timing may be either of their timing and is adjustable by spring load of the coil spring 19 or the compression spring 30.

Thus, in cooperation with the clamping operation, the upper bracket 4 and the upper lock plate 25, and the lower bracket 6 and the lower lock plate 18 are properly positioned respectively, and they do not move in the right/left direction.

Accordingly, after the leading ends of the leg portions of the staple have abutted on the clincher 5, the relative position between the fixed clincher 5 side and the driver 2 side is kept. In result, even in case that a moving mechanism for the upper bracket 4 and the lower bracket 6, which does not have so much positioning accuracy in the transporting time, is used, accuracy of the relative position between the fixed clincher 5 and the driver 2 in the stapling time can be improved, and the resistance to lateral misalignment in the right/left direction due to clinching load can be improved greatly, whereby the stapling operation is surely performed.

Also in the saddle stitching stapler having the above constitution, by the simple structure, the driver 2 side and the clincher 5 side can be exactly positioned in the stapling time.

<Fourth Exemplary Embodiment>

Figure 10:
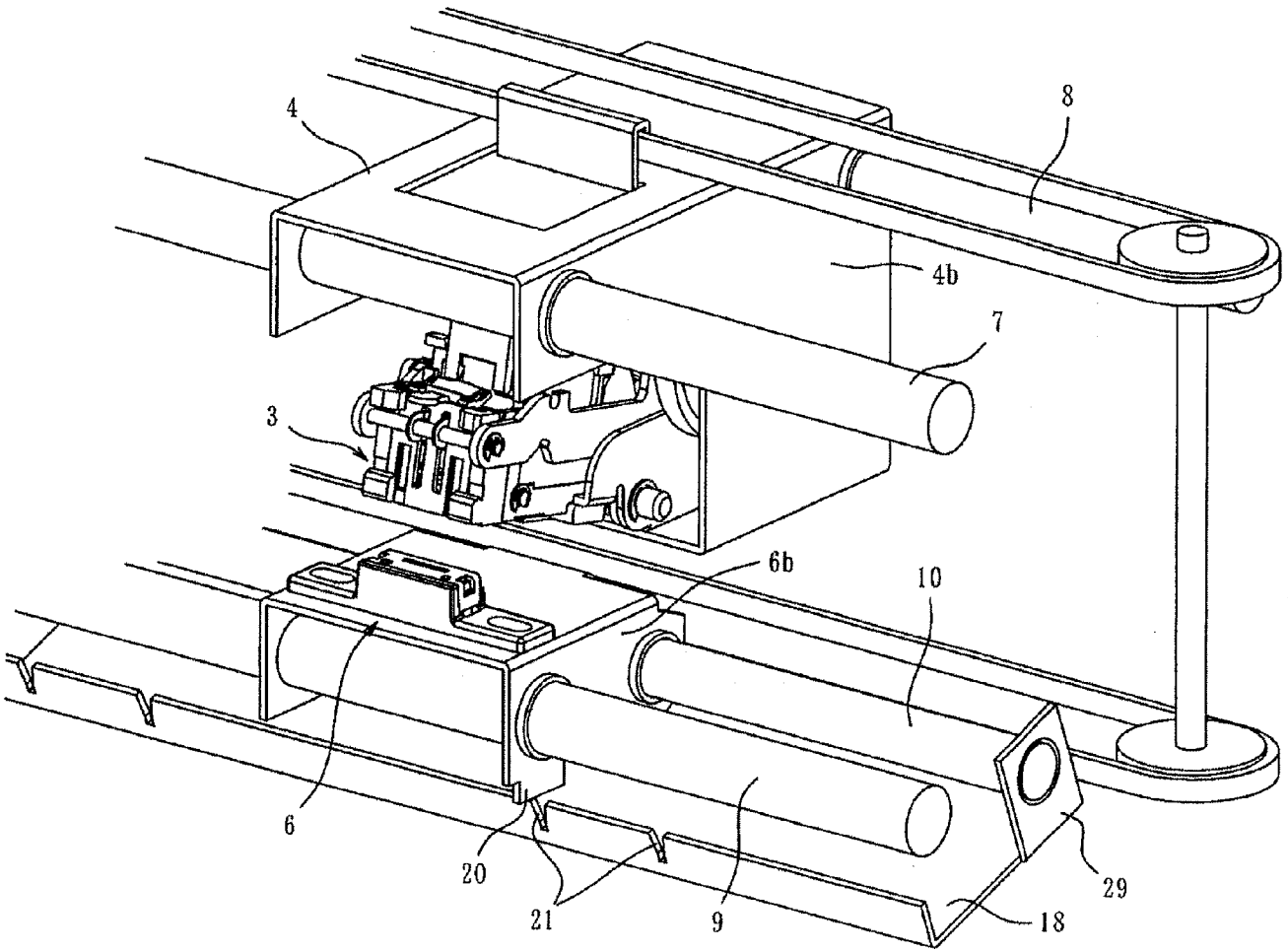
FIG. 10 is a perspective view of a main part of a saddle stitching stapler according to a fourth exemplary embodiment of the invention.

Next, FIG. 10 is a perspective view of an example in which another form of positioning mechanism is provided in a similar saddle stitching stapler to the above-mentioned stapler, in which at the lower end of a side plate 6*b* of a lower bracket 6, a projection 20 is formed as a positioning element (second positioning element); and at the upper surface portion of a lock plate (positioning member) 18, a positioning groove 21 is formed as a positioning element (first positioning element).

Bending pieces 29 formed at both-sided rear ends of the lock plate 18 are supported rotatably up and down around a rear shaft 10 of a lower guide shaft. The lock plate 18 is so constituted as to be moved rotationally upward by a suitable means in cooperation of the clamping operation before the stapling operation after completion of a right/left movement of the stapler.

According to the aforesaid constitution, in cooperation with the clamping operation, the lock plate 18 moves rotationally, and the projection 20 of one side plate 6*b* engages with the positioning groove 21 of the lock plate 18. Hereby, the lower bracket 6 and a clincher 5 are properly positioned.

As long as the rotational movement of the lock plate 18 is performed in cooperation of the clamping operation, an actuating mechanism is not limited. The lock plate 18 may be moved by a link/cam mechanism, a solenoid mechanism, or an electric or mechanical mechanism.

<Fifth Exemplary Embodiment>

Figure 11:
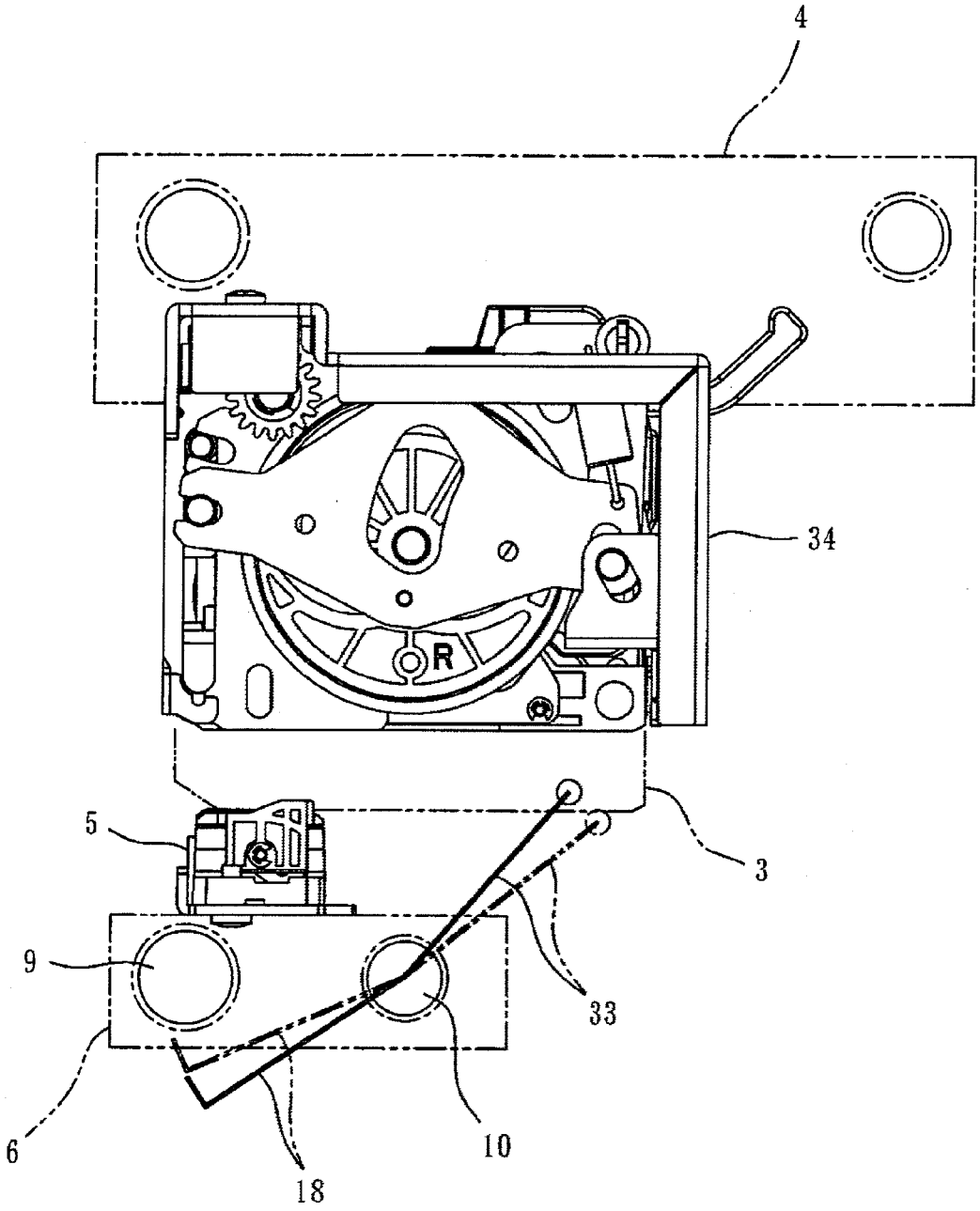
FIG. 11 is a side view of a main part of a saddle stitching stapler according to a fifth exemplary embodiment of the invention.

FIG. 11 shows a form of a driving means for a lock plate 18 which is a positioning member, in which a driving piece 33 is extended from the rear of the lock plate 18 and a leading end of the driving piece 33 is arranged below a magazine unit 3 provided for an upper bracket 4. At this time, an opening in which sheets of paper pass is secured between the upper bracket 4 and the leading end of the driving piece 33. The magazine unit 3 is arranged movably in the up/down direction with respect to a stapler body 34.

According to the aforesaid constitution, when sheets of paper are put between the magazine unit 3 and a clincher 5 and a driver actuating mechanism is operated, the magazine unit 3 moves downward and then performs a clamping operation.

Since the lower surface of the magazine unit 3 provided for a head part presses down the leading end of the driving piece 33 of the lock plate in cooperation with this clamping operation, the front portion of the lock plate 18 moves rotationally upward around a rear shaft 10, and a projection 20 of one side plate portion 6*b* of a lower bracket 6 engages with a positioning groove 21 of the lock plate 18, whereby the relative position between the fixed clincher 5 side and the driver 2 side is kept. In result, even in case that a moving mechanism for the upper bracket 4 and the lower bracket 6, which does not have so much positioning accuracy in the transporting time, is used, accuracy of the relative position between the fixed clincher 5 and the driver 2 in the stapling time can be improved, and the resistance to lateral misalignment in the right/left direction due to clinching load can be improved greatly.

Accordingly, also in the above constitution, by the simple structure, the driver side and the clincher 5 side can be properly positioned in the stapling time.

According to one or more embodiments of the invention, the stapler is provided with the driver support part 4 which supports the actuating mechanism for the driver 2 which drives out a staple toward sheets of paper; the clincher support part 6 which is arranged apart from the driver support part 4 in an up/down direction and to which the clincher 5 for clinching the driven-out staple is fixed; the positioning member 18, 9, 25 provided in a vicinity of one of the clincher support part 6 and the driver support part 4; the first positioning element 21, 24 provided on the positioning member 18, 9, 25; and the second positioning element 20, 22 provided on the one of the clincher support part 6 and the driver support part 4. The clincher support part 6 and the driver support part 4 are simultaneously movable in the right/left direction by substantially the same amount. After the clamping operation of clamping the sheets of paper between the driver support part 4 and the clincher support part 6, the driver 2 carries out a stapling operation. The first positioning element 21, 24 and the second positioning element 20, 22 are so constituted so as to engage with each other in cooperation with the clamping operation.

According to the above structure, the positioning member is provided in the vicinity of the clincher support part or the driver support part, and the positioning elements respectively provided on the clincher support part or the driver support part and the positioning member are engaged with each other in cooperation of the clamping operation. Therefore, by the simple structure, the driver side and the clincher side can be exactly positioned in the stapling time. Accordingly, commercialization of a finisher having a two-side moving mechanism, which is a stapler including the up/down separation typed driver and fixed clincher, is possible enough. Further, the number of parts for determining the stapling pitch is small, so that quality is stabilized.

The positioning member 18 may be provided in the vicinity of the clincher support part 6, the clincher support part 6 may be provided movably toward the positioning member 18, and the clincher support part 6 may be moved toward the positioning member 18 by the pressing force from the driver support part 4 in the clamping operation to engage the first positioning element 21 and the second positioning element 20 with each other. According to this structure, since the pressing power in the clamping time can be directly utilized, the special means for moving the clincher support part is not required, so that the structure is simplified.

The positioning member 25 may be provided in the vicinity of the driver support part 4, the driver support part 4 may be provided movably toward the positioning member 25, and the driver support part 4 may be moved toward the positioning member 25 in cooperation with the clamping operation to engage the first positioning element 21 and the second positioning element 20 with each other. According to this structure, the driver support part can be located properly in the predetermined position.

The positioning member 18 may be provided in the vicinity of the clincher support part 6, the positioning member 18 may be constituted movably toward the clincher support part 6, and the positioning member 18 may be moved toward the clincher support part 6 in cooperation with the clamping operation to engage the first positioning element 21 and the second positioning element 22 with each other. According to this structure, the special means for moving the clincher support part is not required.

The first positioning element 21, 24 and the second positioning element 20, 22 may be constituted by a concave part and a convex part which can be engaged with each other.

According to this structure, under the simple structure, widening of the opening end of the concave part guides the engagement of the convex part and enables secure positioning.

The positioning member 18, 9 may be arranged extendingly in the right/left direction, and the first positioning element may include a plurality of positioning points 21, 24 which are formed on the positioning member 18, 9 and arranged at predetermined intervals in the right/left direction. According to this structure, machining of the positioning member is simplified.

DESCRIPTION OF REFERENCE NUMERALS AND SIGNS

1 Magazine
4 Upper bracket (driver support part)
5 Clincher
6 Lower bracket (clincher support part)
18 (Lower) lock plate (positioning member)
20 Projection (second positioning element)
21 Positioning groove (first positioning element, positioning point)
22 Lock pin (second positioning element)
24 Positioning recess part (first positioning element, positioning point)
25 Upper lock plate (positioning member)

What is claimed is:

1. A stapler comprising:

a driver support part that supports an actuating mechanism of a driver for driving a staple toward sheets of paper;

a clincher support part that is arranged apart from the driver support part in an up/down direction, and to which a clincher for clinching the driven staple is fixed;

a positioning member provided in a vicinity of the clincher support part;

a first positioning element provided on the positioning member; and a second positioning element provided on the clincher support part, wherein the driver support part and the clincher support part are configured to be simultaneously movable in a right/left direction by substantially the same amount;

wherein the driver is configured to carry out a stapling operation, after a clamping operation of clamping the sheets of paper between the driver support part and the clincher support part;

wherein the first positioning element and the second positioning element are configured to engage with each other in cooperation with the clamping operation;

wherein the positioning member is movable toward the clincher support part; and wherein the positioning member is configured to move toward the clincher support part in cooperation with the clamping operation, thereby to engage the first positioning element and the second positioning element with each other.

2. A stapler comprising:

a driver support part that supports an actuating mechanism of a driver for driving a staple toward sheets of paper;

a clincher support part that is arranged apart from the driver support part in an up/down direction, and to which a clincher for clinching the driven staple is fixed;

a positioning member provided in a vicinity of one of the clincher support part and the driver support part;

a first positioning element provided on the positioning member; and a second positioning element provided on said one of the clincher support part and the driver support part, wherein the driver support part and the clincher support part are configured to be simultaneously movable in a right/left direction by substantially the same amount when the first positioning element and the second positioning element are disengaged from each other;

wherein the driver is configured to carry out a stapling operation, after a clamping operation of clamping the sheets of paper between the driver support part and the clincher support part; and wherein the first positioning element and the second positioning element are configured and wherein the positioning member is movable toward the clincher support part in cooperation with the clamping operation.

3. The stapler according to claim 2, wherein the positioning member is provided in the vicinity of the clincher support part;

the clincher support part is movable toward the positioning member; and the clincher support part is configured to move toward the positioning member by a pressing force from the driver support part in the clamping operation, thereby to engage the first positioning element and the second positioning element with each other.

4. The stapler according to claim 2, wherein the positioning member is provided in the vicinity of the clincher support part;

the second positioning element is supported by the clincher support part so as to be movable in the up/down direction with respect to the clincher support part; and the second positioning element is configured to be pressed down by a pressing power from the driver support in the clamping operation, thereby to engage the first positioning element and the second positioning element with each other.

5. The stapler according to claim 2, wherein the positioning member is provided in the vicinity of the driver support part;

the driver support part is movable toward the positioning member; and the driver support part is configured to move toward the positioning member in cooperation with the clamping operation, thereby to engage the first positioning element and the second positioning element with each other.

6. The stapler according to claim 2, wherein the first positioning element and the second positioning element are structured by a concave part and a convex part which are engagable with each other.

7. The stapler according to claim 2, wherein the positioning member extends in a right/left direction; and the first positioning element includes a plurality of positioning points, and the plurality of positioning points are formed on the positioning member and arranged at predetermined intervals in the right/left direction.

8. The stapler according to claim 2, wherein the first positioning element and the second positioning element are urged so that the first positioning element and the second positioning element disengage from each other.

* * * * *